US006368198B1

(12) United States Patent
Sung et al.

(10) Patent No.: US 6,368,198 B1
(45) Date of Patent: Apr. 9, 2002

(54) DIAMOND GRID CMP PAD DRESSER

(75) Inventors: Chien-Min Sung; Frank Lin, both of Taipei (TW)

(73) Assignee: Kinik Company, Taipei County (TW)

( * ) Notice: Subject to any disclaimer, the term of this patent is extended or adjusted under 35 U.S.C. 154(b) by 0 days.

(21) Appl. No.: 09/558,582

(22) Filed: Apr. 26, 2000

Related U.S. Application Data

(63) Continuation-in-part of application No. 09/447,620, filed on Nov. 22, 1999.

(51) Int. Cl.[7] ..... B24B 21/18
(52) U.S. Cl. ..... 451/443; 451/41; 451/285
(58) Field of Search ..... 451/56, 41, 443, 451/444, 285, 287, 526, 539, 540, 548

(56) References Cited

U.S. PATENT DOCUMENTS

| | | | | |
|---|---|---|---|---|
| 5,246,884 A | | 9/1993 | Jaso | 437/225 |
| 5,527,424 A | | 6/1996 | Mullins | 156/636.1 |
| 5,746,931 A | | 5/1998 | Graebner | 216/88 |
| 5,816,891 A | | 10/1998 | Woo | 451/6 |
| 5,833,519 A | | 11/1998 | Moore | 451/56 |
| 5,902,173 A | | 5/1999 | Tanaka | 451/56 |
| 5,916,011 A | | 6/1999 | Kim | 451/41 |
| 5,921,856 A | * | 7/1999 | Zimmer | 451/539 |
| 5,961,373 A | | 10/1999 | Lai | 451/41 |
| 6,106,382 A | * | 8/2000 | Sakaguchi | 451/56 X |
| 6,190,240 B1 | * | 2/2001 | Kinoshita et al. | 451/56 |
| 6,213,856 B1 | * | 4/2001 | Cho et al. | 451/56 X |

FOREIGN PATENT DOCUMENTS

| | | | |
|---|---|---|---|
| JP | 10128654 A | 5/1998 | |
| JP | 10180618 A | 7/1998 | |
| JP | 11048122 A | 2/1999 | |
| JP | 11077536 A | 3/1999 | 53/12 |

* cited by examiner

*Primary Examiner*—Joseph J. Hail, III
*Assistant Examiner*—Anthony Ojini
(74) *Attorney, Agent, or Firm*—Thorpe, North & Western, LLP

(57) ABSTRACT

The present invention discloses a CMP pad dresser which has a plurality of uniformly spaced abrasive particles protruding therefrom. The abrasive particles are super hard materials, and are typically diamond, polycrystalline diamond (PCD), cubic boron nitride (cBN), or polycrystalline cubic boron nitride(PcBN). The abrasive particles are brazed to a substrate which may be then coated with an additional anti-corrosive layer. The anti-corrosive layer is usually a diamond or diamond-like carbon which is coated over the surface of the disk to prevent erosion of the brazing alloy by the chemical slurry used in conjunction with the CMP pad. This immunity to chemical attack allows the CMP pad dresser to dress the pad while it is polishing a workpiece. In addition to even spacing on the substrate, the abrasive particles extend for a uniform distance away from the substrate, allowing for even grooming or dressing of a CMP pad both in vertical and horizontal directions. A method of producing such a CMP pad dresser is also disclosed.

24 Claims, 2 Drawing Sheets

DIAMOND GRID CMP PAD DRESSER

INVENTION PRIORITY

This patent application is a continuation-in-part of U.S. patent application Ser. No. 09/447,620 filed Nov. 22, 1999.

THE FIELD OF THE INVENTION

The present invention relates generally to a device and method for dressing or conditioning a CMP pad. More particularly, the present invention relates to a dressing disk of a super hard material, such as diamond or cubic boron nitride, for dressing or conditioning a CMP pad. Even more particularly, the present invention relates to a dressing disk having evenly spaced abrasive particles thereon, which is coated with a thin film of diamond like carbon for protection from chemical attack.

BACKGROUND OF THE INVENTION

Many industries are now using a chemical mechanical process (CMP) for polishing certain work pieces. Particularly, the computer manufacturing industry has begun to rely heavily on CMP processes for polishing wafers of ceramics, silicon, glass, quartz, and metals thereof. Such a polishing process generally entails applying the wafer against a rotating pad made from a durable organic substance such as polyurethane. To the pad, is added a chemical slurry containing a chemical capable of breaking down the wafer substance, and an amount of abrasive particles which act to physically erode the wafer surface. The slurry is continually added to the spinning CMP pad, and the dual chemical and mechanical forces exerted on the wafer cause it to be polished in a desirable manner.

Of particular importance to the quality of polishing produced, is the distribution of the abrasive particles throughout the pad. The top of the pad holds the particles, usually by a means such as fibers, which provide the friction necessary to allow the abrasives to act on the wafer, rather than being thrown off of the pad. Therefore, it is extremely important to keep the top of the pad as flexible as possible.

A problem with maintaining the top of the pad is due to the accumulation of polishing debris coming from the work piece, abrasive slurry, and dressing disk. This accumulation causes a "glazing" or hardening of the top of the pad, which makes the pad less able to hold the abrasive particles of the slurry.

Therefore, attempts have been made to revive the top of the pad by "combing" it with various devices. This process has come to be known as "dressing" or "conditioning" the CMP pad. Many types of devices and processes have been used for this purpose. One such device is a disk with a plurality of super hard crystalline particles, such as diamond particles attached to a surface, or substrate thereof.

Unfortunately, such diamond disks made by conventional methods exhibit several problems. First, diamonds have become dislodged from the substrate of the disk and are caught in the CMP pad fibers. This leads to scratching of the work piece being polished. Second, the production methods of the past tend to produce disks having diamonds that are clustered in groups, or unevenly spaced on the surface of the substrate. This uneven grouping causes some portions of the CMP pad to be overdressed which creates wear marks, while others are underdressed which creates glazing layers. In either case, pad polishing efficiency is reduced, and uneven polishing occurs. Finally, the diamonds of these disks do not extend to a uniform height above the substrate surface of the disk. This non-uniformity additionally creates uneven dressing of the CMP pad, because many particles from the dresser may not touch the pad.

The dislodging of diamonds from the disk substrate is due to the inferior method by which they have been attached. When diamonds are held by electroplated nickel to the substrate, there is no bonding force but mechanical locking of the diamond. Hence, these particles will become dislodged as soon as they are rocked loose. This dislodgement process is facilitated by the chemical attack on the electroplating material which is presented by the chemical slurry.

On the other hand, when diamonds are brazed onto the substrate, the chemical force holds the diamond more firmly. However, the acids of the chemical slurry quickly weaken the braze-diamond bonds and dislodge the diamonds under the friction of pad dressing. Therefore, to minimize the exposure of the braze to the chemicals, the polishing processes was halted while the dressing occurred, and then started again. This sequence of alternately polishing and then dressing wastes an enormous amount of time, and is extremely inefficient.

In view of the foregoing, a CMP pad dresser which provides an even grooming of the CMP pad is desirable. Additionally, a CMP pad dresser which grooms a CMP pad to an even depth is very desirable. Further, a CMP pad dresser which is less susceptible to diamond particle dislodgment is highly desirable. Finally, a CMP pad dresser which may resist the acid attack of a chemical slurry, and continually dress the CMP pad, even while polishing is being performed, is extremely desirable.

OBJECTS AND SUMMARY OF THE INVENTION

It is therefore an object of the present invention to provide a CMP pad dresser which is capable of using abrasive particles to evenly dress or condition, the CMP pad.

It is an additional object of the present invention to provide a CMP pad dresser which is less susceptible to abrasive particle dislodgement.

It is another object of the present invention to provide a CMP pad dresser which is corrosion resistant so that it is capable of constantly dressing a CMP pad, even while the pad is engaged in the act of polishing.

It is also an object of the invention to provide a chemical barrier that prevents the dissolution of elements from the disk which will contaminate a wafer being polished.

It is a further object of the invention to provide a method of dressing or conditioning a CMP pad evenly.

It is additionally an object of the present invention to provide a method of reducing the susceptibility of a CMP pad dresser to abrasive particle dislodgment even when the pad is immersed in an acid slurry.

The above objects and others not specifically recited are achieved in a specific illustrative embodiment of a CMP pad dresser which has a plurality of evenly spaced abrasive particles affixed to a substrate. Generally, the particles are of a super hard substance such as diamond, or cubic boron nitride (cBN), in either the single crystal or polycrystalline form.

In one method of forming the CMP pad dresser of the present invention, a braze powder and an organic binder are first mixed thoroughly to form a dough. The dough is then rolled between two rollers to form a flexible sheet of brazing alloy. The abrasive particles are then evenly placed on the sheet of brazing alloy by use of a template which contains a plurality of evenly spaced apertures. The apertures of the template are larger than the size of one abrasive particle or "grit," but smaller than the size of two. Once all the apertures have been filled with abrasive particles, any excess abrasive particles are removed, and the abrasive particles are pressed into the brazing alloy sheet to embed them therein, by using a generally flat surface such as a steel plate. The template is then removed, and the abrasive particle containing brazing alloy, is affixed to the substrate with an acrylic glue. Finally, the whole assembly is brazed in a vacuum furnace to complete the brazing process and firmly fix the abrasive particles to the substrate.

Alternatively, the abrasive particles may be affixed to the substrate with an acrylic glue, using the template as described above. Next, the brazing alloy particles are showered onto the abrasive particles and substrate. Finally, the whole assembly is heated in a vacuum brazing furnace to complete the brazing process and firmly affix the abrasive particles to the substrate.

By using the template to place the abrasive particles in a controlled manner, any desired pattern of placement may be achieved. This pattern may be nearly any conceivable pattern, but most importantly provides the ability to evenly space the abrasive particles on the substrate. Additionally, by using a template with uniformly sized apertures, a uniform size of each abrasive particle is ensured. Finally, using a flat surface to press the abrasive particles into the substrate, creates a uniform height of the abrasive particles protruding above the substrate surface. This uniform height of abrasive particles ensures plowing, or dressing of the CMP pad to a uniform depth. Further, the uniform distribution of the abrasive particles across the substrate allows for a uniform dressing of the pad across its surface.

After affixing the abrasive particles to the substrate, a thin coating of additional anti-corrosive material may be applied to the CMP pad dresser. Such a coating effectively "seals" the surface of the CMP pad dresser. Such a sealant protects the abrasive particles and the braze, or other fixing agent and reduces their susceptibility to chemical attack from the chemicals of the abrasive slurry, especially those slurries containing acids. As the face of the CMP pad dresser is rendered less susceptible to chemical degradation, so also is lessened its susceptibility to abrasive particle dislodgement. Therefore, the CMP pad dresser is able to continually dress the CMP pad, even during a polishing act, because the agent binding the abrasive particles to the substrate is protected from chemical degradation.

The above and other objects, features and advantages of the invention will become apparent from a consideration of the following detailed description presented in connection with the accompanying drawings.

DETAILED DESCRIPTION OF THE INVENTION

Before the present CMP pad dresser and accompanying methods of use and manufacture are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and, "the" include plural referents unless the context clearly dictates otherwise. Thus, for example, reference to a "abrasive particle" or a "grit" includes reference to one or more of such abrasive particles or grits.

In describing and claiming the present invention, the following terminology will be used in accordance with the definitions set forth below.

As used herein, "abrasive particle," or "grit," or similar phrases mean any super hard crystalline, or polycrystalline substance, or mixture of substances and include but is not limited to diamond, polycrystalline diamond (PCD), cubic boron nitride, and polycrystalline cubic boron nitride (PCBN). Further, the terms "abrasive particle," "grit," "diamond," "polycrystalline diamond (PCD)," "cubic boron nitride," and "polycrystalline cubic boron nitride, (PCBN)," may be used interchangeably.

As used herein, "substrate" means the a base portion for a CMP dresser having a surface on which the abrasive particles may be affixed. The base portion may be any shape, thickness, or material, and includes but is not limited to metals, alloys, ceramics, and mixtures thereof.

As used herein, "euhedral" means idiomorphic, or having an unaltered natural shape.

As used herein, "sharp point" means any narrow apex to which a crystal may come, including but not limited to corners, ridges, obelisks, and other protrusions.

As used herein, "metallic" means any type of metal, metal alloy, or mixture thereof, and specifically includes but is not limited to steel, iron, and stainless steel.

Applicant has discovered a device for improving the efficiency and quality of conditioning or dressing a CMP pad. A method for using and fabricating the device are included herein. By using the device to condition or dress a CMP pad, not only is the pad life extended, but also the constancy at which the pad may be used, and therefore, the speed at which it accomplishes its work are both improved.

Figure 1:
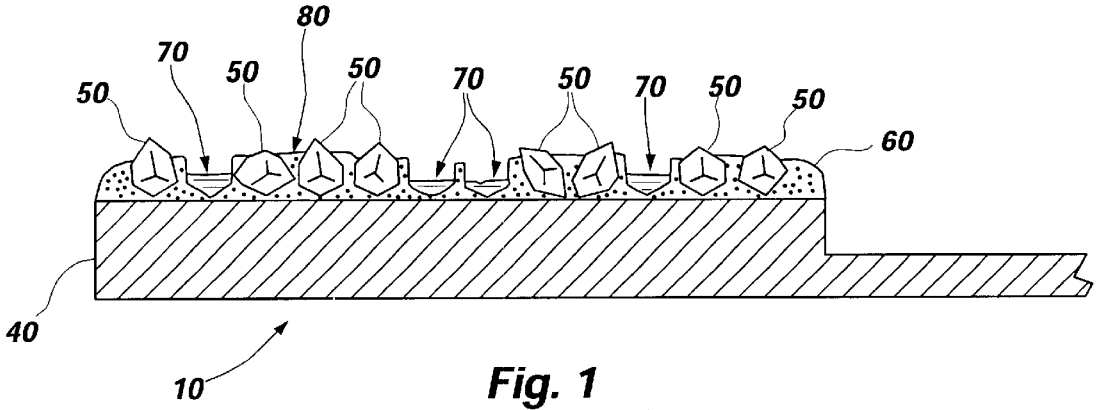
Fig. 1 (PRIOR ART)
FIG. 1 is a side view of a prior art CMP pad dresser which employs an electroplating method for fixing the diamonds to the disk substrate.

Referring now to FIG. 1, there is shown a prior art CMP pad dresser 10, which has a plurality of diamond particles, 50 electroplated to a substrate 40. Electroplating material 60, is generally nickel precipitated out of an acid solution. Such an electroplating method is not only costly and time consuming, but is also environmentally hazardous because of the residual substances created by the process.

Electroplated CMP pad dresser 10 has many disadvantages which are apparent as shown in FIG. 1. First, the electroplating material 60 is incapable of forming any chemical bonds with diamond particles 50. Therefore, only weak mechanical forces hold the diamond particles 50 onto substrate 60. Such mechanical forces are quickly overcome by the greater friction force acting on diamond particles 50, which are easily loosened from electroplating material 60, leaving voids in electroplating material 60, such as spaces 70, when the pad dresser is rotated against a CMP pad. Such voids are quickly filled with residue which is polished off of the workpiece, as well as chemicals and abrasive particles from the slurry, which further weaken electroplating material 60.

Because the mechanical forces created by electroplating material 60 are the only means holding diamond particles 50 onto substrate 40, exposure of diamond particles 50, above the electroplating material must be kept to a minimum. Therefore, contact between electroplating material 60 and the CMP pad is inevitable. Such contact wears the electroplating material and facilitates the release of diamond particles 50. Additionally, electroplating material 60 tends to bubble up around diamonds 50, in places such as convex portion 80. The bubbles, in addition to the already low exposure and tight spacing of diamond particles 50, makes significant penetration of diamond particles 50 into the CMP pad fibers different, if not impossible. Without such penetration, the dressing process is severely handicapped.

Figure 2:
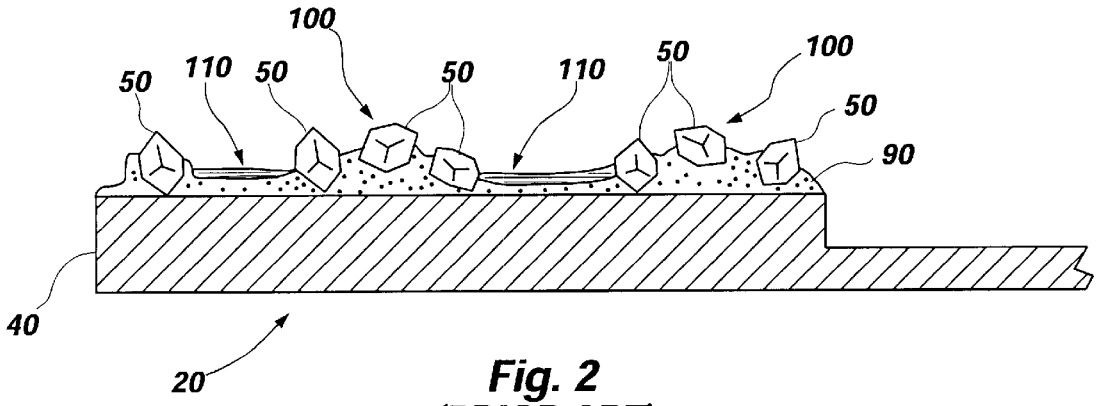
Fig. 2 (PRIOR ART)
FIG. 2 is a side view of a prior art CMP pad dresser which is made by using a traditional brazing method for fixing the diamond particles to the disk substrate.

Referring now to FIG. 2, there is shown prior art CMP dresser pad 20 with substrate 40, having diamond particles 50, brazed to substrate 40, using brazing material 90, and conventional brazing techniques. Brazing materials generally comprise a metal alloy mixed with carbide formers. Such carbide formers allow diamond particles 50 to chemically bond to brazing material 90, which in turn bonds with substrate 40. This bonding arrangement significantly increases the strength of CMP dresser 20, but is accompanied by some undesirable side effects.

Brazing material 90 must be kept to a minimum in order to keep it from completely covering diamond particles 50. Therefore, diamond particles 50 are wrapped in only a thin coating of brazing material 90. This problem is compounded by the fact that typical brazing materials are very mechanically weak. This mechanical weakness offsets the strength of the chemical bonds between diamond particles 50 and brazing material 90, because the brazing material itself will shear off with the detached diamond particle.

An additional problem with brazing material 90 is that it is very susceptible to chemical attack by the abrasive slurry. Such chemical attack contributes to the detachment of diamond particles 50, as it weakens brazing material 90 which is already mechanically weak. Therefore, in order to reduce exposure of CMP pad dresser 20 to the chemical slurry, polishing of the workpiece must be paused, and the chemical slurry allowed to leave the pad before pad dresser 20 is applied. Such pauses in the polishing process greatly increase the time required to produce a finished product, and is inefficient.

Another drawback to conventional brazing is that the surface tension of the molten metal alloy tends to cause the abrasive particles to "cluster" when applied to substrate 40. Such clustering is illustrated at 100, learning gaps 110. The overall effect is an uneven distribution of diamond particles 20, which makes grooming inefficient. This inefficiency is due to gaps 110, which cause areas of the CMP pad to remain unconditioned. This uneven conditioning causes areas of the CMP pad to wear out faster than others, with the overall result that the workpiece will receive an uneven polish because the worn out areas polish less effectively than the properly conditioned areas.

Figure 3:
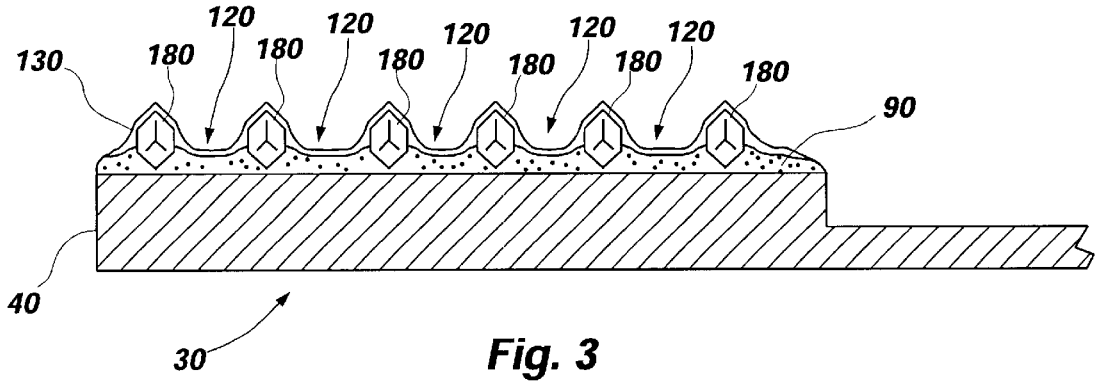
FIG. 3 is a side view of a CMP pad dresser made in accordance with the principles of the present invention.

Another effect which the clustering of abrasive particles creates is the forming of mounds in brazing material 90. Mount formation raises some diamond particles to a height above substrate 40 which is greater than that of other abrasive particles. Therefore, the highest protruding abrasive particles may penetrate so deeply into the fibers of the CMP pad, that they will prevent lesser protruding abrasive particles from having any grooming effect. This also causes conditioning inefficiency and incongruity. In contrast to the CMP pad dressers of the prior art, the present invention allows even dressing of the CMP pad. Referring now to FIG. 3, there is shown a CMP pad dresser made in accordance with the principles of the present invention. The CMP pad dresser has a plurality of abrasive particles 180 affixed to substrate 40 with brazing material 90. Abrasive particles 180, may be of any super hard material. Preferred materials include, but are not limited to diamond, polycrystalline diamond (PCD), cubic boron nitride (CBN) and polycrystalline cubic born nitride (PCBN).

Also shown in FIG. 3, is anti-corrosive layer 130. This anti-corrosive layer is formed over the surface of the CMP pad dresser after abrasive particles 180 have been affixed to substrate 40 by the below described method. Anti-corrosive layer 130 is another super hard material such as diamond, diamond-like-carbon, or CBN, and may match the abrasive particles 180 material. In a preferred embodiment, anti-corrosive layer 130 is comprised of at least about 90–95% diamond, or diamond-like-carbon. Anti-corrosive layer 130, may be of any thickness, but is generally in the range of 0.5 to 5 $\mu$m. In a preferred embodiment, anti-corrosive layer 130 has a thickness of about 1 to 3 $\mu$m. Such a thin anti-corrosive layer 130 may be produced by a physical vapor deposition (PVD) method. PVD methods such as the use of a cathodic arc with a graphite cathode, are known in the art and may be used to produce anti-corrosive layer 130.

The advantage provided by anti-corrosive layer 130, is that it effectively "seals" the working surface, and may also seal any other desired surfaces of the CMP pad dresser which may be vulnerable to chemical attack. As a sealant, anti-corrosive layer 130 protects brazing material 90 from chemical attack by the abrasive chemical slurry held within the CMP pad. This protection allows CMP pad dresser 30 to continually dress a CMP pad, even while the pad is polishing a workpiece, and eliminates the production pauses used to prolong the life of prior art CMP pad dressers. The continual and even dressing of the CMP pad allows for greater production output, and prolongs the life and efficiency of the CMP pad.

Figure 4:
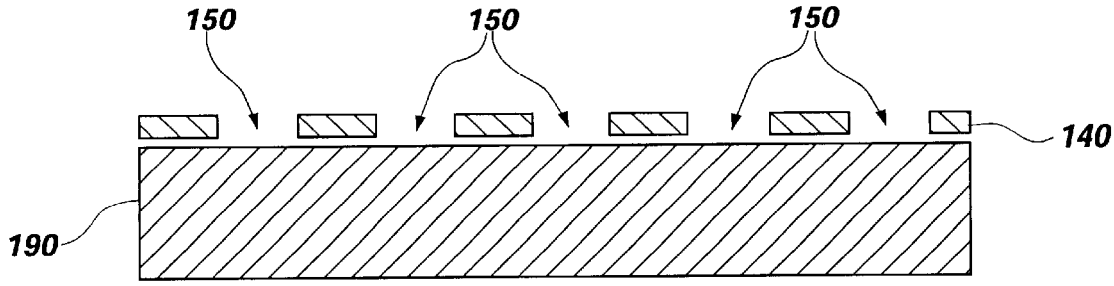
FIG. 4 is a side view of a sheet of brazing alloy with a template for placing abrasive particles on the surface thereof in accordance with the principles of the present invention.
Figure 5:
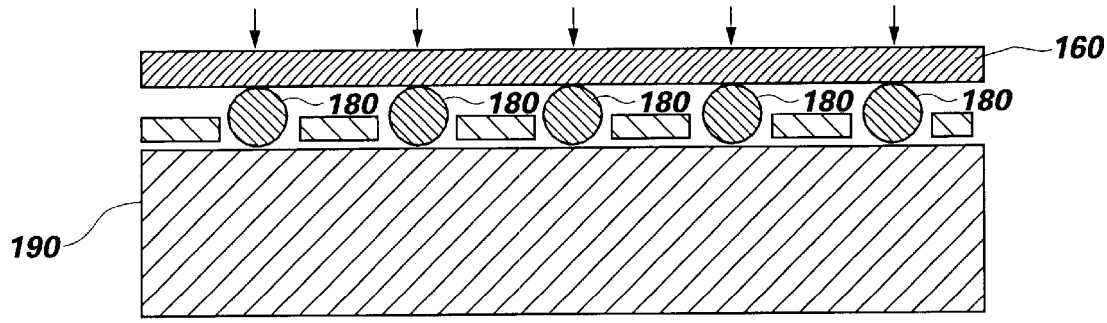
FIG. 5 is a side view of a sheet of brazing alloy with a template on its surface, and abrasive particles filling the apertures of the template. A flat surface is shown for use in pressing the abrasive particles into the sheet of brazing alloy in accordance with the principles of the present invention.
Figure 6:
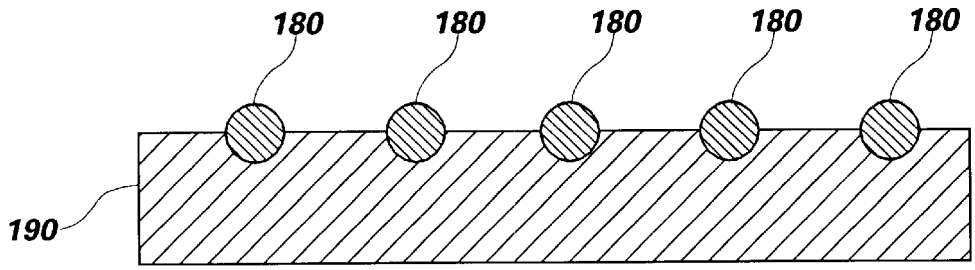
FIG. 6 is a side view of a sheet of brazing alloy having abrasive particles pressed into it in accordance with the principles of the present invention.

One method of affixing abrasive particles 180 to substrate 40 is shown in FIGS. 4–6. First, template 140 having apertures 150 is placed upon sheet of brazing alloy 90. The use of the template allows placement of abrasive particles 180 to be controlled by designing the template with apertures in a desired pattern. Patterns for abrasive particle placement may be selected by one ordinarily skilled in the art to meet the particular needs of the conditions for which the CMP pad dresser is to be used.

In one aspect of the invention, distribution of the apertures will be in a grid pattern with the space between the apertures being predetermined to produce a desired amount of space between abrasive grits 180 on sheet of brazing alloy 90. In a preferred embodiment, the grits are evenly spaced at a distance of about 1.5 to about 10 times the size of each grit.

After template 140 is place on brazing alloy sheet 90, apertures 150 are filled with abrasive particles 180. Apertures 150 have a predetermined size, so that only one abrasive particle will fit in each aperture. Any size of abrasive particle, or grit is acceptable, however in one aspect of the invention, the particle sizes are from about 100 to about 350 micrometers in diameter.

In another aspect of the invention, the size of the apertures in the template may be customized in order to obtain a pattern of abrasive particles either varying in size, or substantially uniform in size. In a preferred embodiment, the apertures of the template are sufficient to select only grits which are within 50 micrometers in size of each other. This uniformity of grit size contributes to the uniformity of CMP pad grooming, as the work load of each abrasive particle is evenly distributed. In turn, the even work load distribution reduces the stress on individual abrasive particles, and extends the effective life of CMP pad dresser 30.

After the apertures of template 150 are all filled with grits 180, any excess abrasive particles are removed, and flat surface 160 is applied to abrasive particles 180. Flat surface 160 must be of an extremely strong, rigid material, as it must be capable of pushing abrasive particles 180 down into brazing alloy sheet 90. Such materials typically include, but are not limited to steel, iron, alloys thereof, etc.

Abrasive particles 180 are shown to be embedded in brazing alloy sheet 90 in FIG. 6. Because surface 160 was flat, abrasive particles 180 will extend away from substrate 40 to a uniform distance. This distance will be determined by the thickness of template 140, and in a preferred embodiment, each abrasive particle will extend to within 50 micrometers of this distance.

Abrasive particles 180 as shown in FIGS. 4–6 are rounded. However, in FIG. 3, they are pointed. The scope of the present invention encompasses abrasive particles of any shape, including euhedral, or naturally shaped particles. However, in a preferred embodiment, abrasive particles 180 have a sharp point extending in a direction away from substrate 40.

After abrasive particles 180 are embedded in brazing alloy sheet 90, the sheet is affixed to substrate 40 as shown in FIG. 3. The brazing alloy used may be any brazing material known in the art, but is preferably a nickel alloy which has a chromium content of greater than 2% by weight. A brazing alloy of such a composition will be super hard in and of itself, and less susceptible to chemical attack from the abrasive containing slurry. Therefore, when a super hard brazing material is used, anti-corrosive layer 130 is optional.

Because abrasive particles 180 are embedded in brazing alloy sheet 90, the surface tension of the liquid brazing alloy is insufficient to cause particle clustering. Additionally, braze thickening occurs to a much lesser degree and no "mounds" are formed. Rather, the braze forms a concave surface between each abrasive particle, which provides significant support. Finally, in preferred embodiment, the thickness of brazing alloy sheet 90 is chosen to allow about 10 to about 90% of each abrasive particle to protrude above the outer surface of brazing material 90.

As a result of the method for embedding abrasive particles 180 in brazing alloy sheet 90, even spaces 120 are created. Additionally, abrasive grits 180 extend to a uniform height or distance above substrate 40, which means when applied to a CMP pad, they will protrude to a uniform depth within the pad fibers. The even spacing and uniform protrusion causes the CMP to be dressed or groomed evenly, which in turn increases the polishing efficiency of the CMP pad and extends its useful life.

For a greater understanding of the present invention, examples will be provided below. These examples are in no way meant to serve as a limitation to the scope of the present invention.

EXAMPLE 1

Two CMP pad dresser disks were produced as follows. A sheet of braze alloy was made by rolling a mixture of metal powder and an organic binder between two rollers. Diamond grits of MBS970 manufactured by General Electric Company having average sizes of 135 and 225 micrometers were embedded by the aid of a template into the braze alloy sheet. The template used formed the diamond grits into a grid pattern with a distance of 900 micrometers between each diamond grit.

After the placement of the diamond grit particles into the braze alloy sheet, the sheet was then attached to a metal substrate using an acrylic glue. The assembly was then brazed in a vacuum furnace to a temperature of 1000° C. The resultant products were two flat disks having a diameter of about 100 millimeters and a thickness of about 6.5 millimeters.

These disks were then tested against a disk having twice the amount of diamond particles place in a random configuration. The disks were used to dress a 28 inch CMP pad that polished 8 inch silicon wafers by a basic slurry. The results of the test are shown in Table 1 below. DG 135-900 is the disk with the 135 micrometer particles, and DG 225 is the disk with the 225 micrometer particles.

TABLE 1

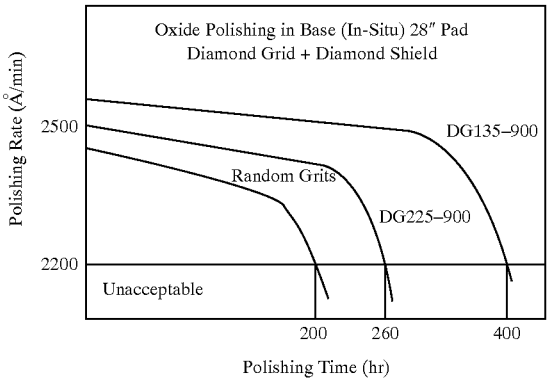

As can be seen, both disks having uniform particle placement significantly outperformed the disk with the randomly placed diamonds. Additionally, the disk with the 135 micrometer particles nearly doubled the performance of the random particle disk.

EXAMPLE 2

Two additional diamond disks were fabricated by the method of Example 1. However, diamond sizes of 225 micrometers and 275 micrometers were used. Additionally, each disk was coated with a 1 micrometer thick diamond-like carbon coating to protect the brazing alloy. The diamond-like carbon film was deposited by a cathodic arc method.

These disks were then compared to a conventional diamond disk by dressing a CMP pad for polishing 8 inch silicon wafers. The pad was immersed in an acid slurry with a pH of 3.0. The dressing was performed in-situ while the polishing was taking place. The results are shown in Table 2 below. DG 275-900 is the disk containing evenly spaced grits of 275 micrometers in size. DG225-900 is the disk containing evenly spaced grits of 225 micrometers in size, and AT is the conventional diamond disk.

TABLE 2

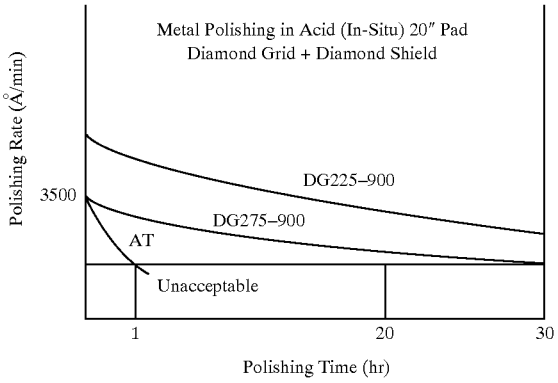

As can be seen from Table 2, the conventionally produced diamond disk is unable to survive in the acid environment of the polishing slurry for more than 1 hour. However, the disks of the present invention survived for more than 30 hours. Such a life span enables significantly better CMP pad dressing results, and constitutes a significant improvement over the prior art. of course, it is to be understood that the above-described embodiments are only illustrative of the application of the principles of the present invention.

Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

What is claimed is:

1. A method of making a chemical mechanical polishing (CMP) pad dresser comprising the steps of:

a) providing a substrate member;

b) placing a template having a predetermined pattern of apertures formed therein on a sheet of braze alloy;

c) filling the apertures of the template with abrasive particles;

d) removing any abrasive particles which are not in a template aperture;

e) pressing the abrasive particles contained in the apertures into the sheet of braze alloy, such that said abrasive particles become partially embedded in the braze alloy;

f) removing the template, such that the abrasive particles remain in place on the sheet of braze alloy; and g) attaching the sheet of braze alloy containing the abrasive particles to the substrate.

2. The CMP pad dresser making method of claim 1, wherein said abrasive particles are crystalline particles of either diamond or cubic boron nitride, either as single crystals or in polycrystalline form.

3. The CMP pad dresser making method of claim 1, wherein said apertures have a size sufficient to accommodate only one abrasive particle.

4. The CMP pad dresser making method of claim 3, wherein said apertures have a predetermined size selected to accommodate abrasive particles of a predetermined size.

5. The CMP pad dresser making method of claim 1, wherein said abrasive particles each have a size within the range of about 100 to 350 micrometers.

6. The CMP pad dresser making method of claim 1, wherein said abrasive particles are substantially uniform in size, such that all abrasive particles have a size within 50 micrometers of each other.

7. The CMP pad dresser making method of claim 1, wherein said apertures of the predetermined pattern are spaced in a manner sufficient to produce a predetermined distance between any two particles.

8. The CMP pad dresser making method of claim 7, wherein said predetermined distance between each particle is about 1.5 to about 10 times the size of the particles.

9. The CMP pad dresser making method of claim 1, wherein said predetermined pattern of apertures is a grid.

10. The CMP pad dresser making method of claim 1, wherein said abrasive particles have a euhedral shape.

11. The CMP pad dresser making method of claim 1, wherein said abrasive particles have a predetermined shape.

12. The CMP pad dresser making method of claim 1, wherein said abrasive particles have a sharp point oriented away from the surface of the substrate.

13. The CMP pad dresser making method of claim 1, wherein said substrate member is made of a metallic material.

14. The CMP pad dresser making method of claim 13, wherein said metallic material is stainless steel.

15. The CMP pad dresser making method of claim 1, wherein said sheet of braze alloy is fabricated by the steps of bonding braze alloy particles together with an organic binder and forming said bonded particles into a sheet of desired thickness.

16. The CMP pad dresser making method of claim 15, wherein said step of forming braze alloy particles into a sheet is accomplished by either rolling, extruding, or tape casting.

17. The CMP pad dresser making method of claim 1, wherein said braze alloy comprises a nickel alloy having a chromium amount of at least about 2 wt %.

18. The CMP pad dresser making method of claim 1, wherein said sheet of braze alloy has a post brazing thickness sufficient to allow exposure of between about 10–90% of each abrasive particle above the brazing alloy.

19. A method of making a chemical mechanical polishing (CMP) pad dresser comprising the steps of:

a) providing a substrate member;

b) uniformly spacing a plurality of abrasive particles upon a surface of said substrate; and c) affixing said abrasive particles to the substrate such that each abrasive particle extends within about 50 micrometers of a predetermined uniform height above the substrate.

20. A method of making a chemical mechanical polishing (CMP) pad dresser comprising the steps of:

a) providing a substrate member;

b) uniformly spacing a plurality of abrasive particles upon a surface of said substrate;

c) affixing said abrasive particles to the substrate such that each abrasive particle extends to a predetermined height above the substrate member; and d) coating said abrasive particles and said braze alloy with an anti-corrosive layer.

21. The CMP pad dresser making method of claim 20, wherein the anti-corrosive layer is comprised of diamond, or diamond-like-carbon.

22. The CMP pad dresser making method of claim 20, where the anti-corrosive layer has a thickness of less than about 3 micrometers.

23. The CMP pad dresser making method of claim 20, wherein the diamond-like-carbon has an atomic carbon content of at least about 95%.

24. The CMP pad dresser making method of 20, wherein said coating step is accomplished using a cathodic arc method.

* * * * *